United States Patent [19]

Budich et al.

[11] 3,964,231

[45] June 22, 1976

[54] PLASTIC-ENCASED METALLIC HOLLOW PROFILE MEMBER

[75] Inventors: Wolfgang Budich; Robert Krah, both of Sieglar; Hans Theissen, Eschmar, all of Germany

[73] Assignee: Dynamit Nobel Aktiengesellschaft, Germany

[22] Filed: Nov. 29, 1973

[21] Appl. No.: 420,053

[30] Foreign Application Priority Data

Nov. 29, 1972 Germany ..... 2258420

[52] U.S. Cl. ..... 52/727; 49/DIG. 2

[51] Int. Cl.[2] ..... E04C 3/30

[58] Field of Search ..... 52/727, 731, 309, 397, 52/724, 725, 588; 49/DIG. 2

[56] References Cited

UNITED STATES PATENTS

| | | | |
|---|---|---|---|
| 3,040,389 | 6/1962 | Fengler | 52/727 X |
| 3,090,083 | 5/1963 | Emmerich | 52/727 |
| 3,348,349 | 10/1967 | Petersen | 52/731 X |
| 3,703,063 | 11/1972 | Budich et al | 52/727 |
| 3,789,563 | 2/1974 | Toti | 52/731 |
| 3,798,869 | 3/1974 | Nipp | 52/731 X |

FOREIGN PATENTS OR APPLICATIONS

| | | | |
|---|---|---|---|
| 1,359,020 | 3/1964 | France | 52/731 |
| 109,126 | 8/1964 | Norway | 49/DIG. 2 |
| 1,008,108 | 1/1964 | United Kingdom | 52/731 |

*Primary Examiner*—Ernest R. Purser
*Assistant Examiner*—Carl D. Friedman
*Attorney, Agent, or Firm*—Craig & Antonelli

[57] ABSTRACT

A frame element, especially for window and door construction, which is formed as a composite member with a hollow metallic profile member covered by a sheath of synthetic resinous material. The sheath includes mounting lugs and grooves for directly supporting window or door members. The hollow metal profile is provided with outer flanges formed as extensions of side walls of the member, which flanges serve to provide a rigid support base for supporting the loads applied to the frame element by way of the sheath. Interlocking groove and strip connections are provided on the sheath and the profile member at the corners formed respectively between the outer flanges and the immediately adjacent joining side wall of the profile member. These interlocking groove and strip connections assure an elastic, resilient seating of the plastic sheath against the outer confines of the profile member over the entire surface of the profile member.

26 Claims, 9 Drawing Figures

PLASTIC-ENCASED METALLIC HOLLOW PROFILE MEMBER

BACKGROUND AND SUMMARY OF THE INVENTION

This invention relates to a metallic hollow profile member with at least one outer flange or projection formed as an extension of a side edge and with a plastic or synthetic resin sheath extruded onto the metallic hollow profile member. The frame elements formed by such plastic encased hollow metal profile members are especially useful for making door and window frames.

In conventional profile members, the bearing surfaces and fittings formed at the relatively soft plastic sheath are fashioned to be self-supporting and thus are unsuitable for greater stresses. Furthermore, plastic-encased metallic hollow profile members have been contemplated wherein the hollow metallic profile member is constructed with projecting stops or contact surfaces, wherein, however, the plastic casing is seated relatively loosely on the metallic core and is detached in the zone of the corners. This relatively loose seating of the synthetic resin sheath on the metallic core also has the disadvantage that often a subsequent shrinking of the plastic casing can occur. The stresses resulting from the shrinking can have such an effect on the weld seams at the junction points of such profile members (for example when used as window and door frames), that these seams sometimes rupture.

The present invention contemplates overcoming the above-discussed problems by providing a profile member having satisfactory strength properties and by affording a flawless seating of the plastic casing on the profile member, so that they can be satisfactorily processed into final products.

According to the present invention, the plastic sheath is fixed in the outside corner formed between the outer flange and the joined adjacent side wall of the hollow metallic profile member. In preferred embodiments of this invention, the plastic sheath is fixed at the outside corner by forming the hollow metallic profile member, in the zone of the corner, with at least one projecting cam, forming an undercut corner groove, and by fashioning the plastic sheath correspondingly at the corner with a cam strip engaging the corner groove. By means of the fixation of the plastic sheath in the set-back corners of the reinforcing metal core, according to the present invention, a flawless seating of the loose plastic sheath is ensured. In this way, stable and friction-fitting, plastic-encased hollow profile members can be produced by extruding the synthetic resin sheath onto the hollow profile member. The present invention also contemplates providing preferred embodiments where the hollow profile member is furthermore roughened by fluting, pitting, sand-blasting, or corresponding surface treatment in order to increase the tight fit between the metallic hollow profile member and the plastic sheath.

In preferred embodiments of the invention, the interlocking elements serving for the fixation of the plastic sheath in the corner formed by the outer flange and the metallic hollow profile member are fashioned to be symmetrical.

In certain preferred embodiments, the plastic sheath, as seen in cross-section, contacts the metallic hollow profile member flush at all points. In other preferred embodiments, the connection is such in the zone of the corner that the plastic sheath, in the zone of the corner, contacts the metallic hollow profile member only partially while being firmly held in position.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
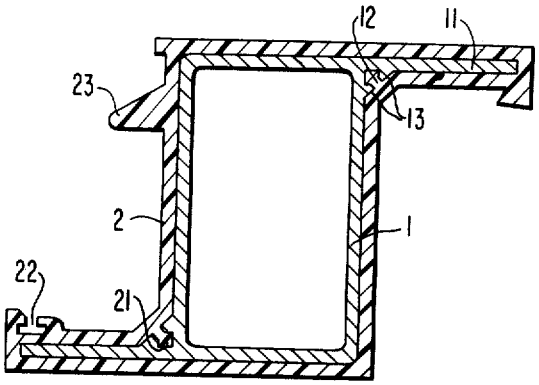
FIG. 1 is a cross-sectional view through a frame element for a window frame which is constructed in accordance with a preferred embodiment of the present invention.

In FIG. 1, plastic-encased metallic hollow profile member 1 is constructed as a frame element, especially for windows and doors, with outer flanges 11 serving as load bearing portions. That is, the outer flanges 11 are formed integrally with the hollow profile member as extensions of the top and bottom side walls thereof so as to form a strong support for loads applied to the frame element at the positions spaced from the hollow box-like portion. Mounting or holding lugs 23 and grooves 22 are provided in the plastic sheath 2 for directly contacting and holding respective window or door structures.

In the zone of the set-back outside corners 12 between the outer flanges 11 and the adjacent side walls of the hollow profile member 1, projecting lugs or cams 13 are formed at the metallic hollow profile member, so that undercut corner grooves are formed which are engaged by the correspondingly formed cam strips 21 of the plastic sheath 2. Cams 13 and cam strips 21 form interlocking elements which assure the fixation and contacting of the plastic sheath 2 with the metallic hollow profile in the zone of the corners 12. Because any tension on the portions of the sheath 2 diverging from these corners 12 would cause a loosening at the corners but for the interlocking cams 13 and cam strips 21, these interlocking elements serve a very useful function in assuring a firm engagement of the sheath 2 and profile member 1. Therefore, the advantages of the metallic flanges 11 for support are obtained while also retaining the advantages of the plastic sheathing.

Figure 2:
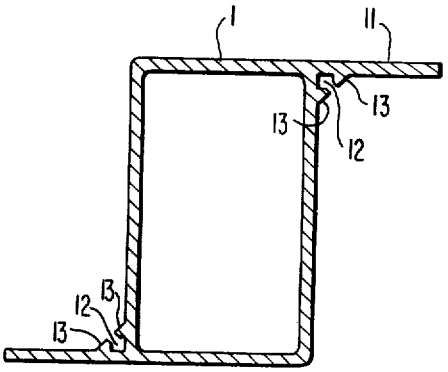
FIG. 2 is a cross-sectional view through the metallic hollow profile member of FIG. 1.
Figure 3:
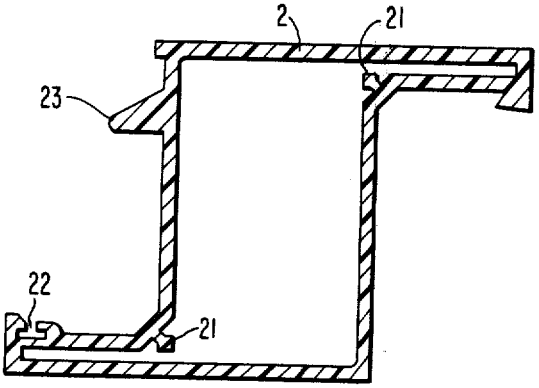
FIG. 3 is a cross-sectional view through the synthetic resin sheath of FIG. 1.

In FIG. 2, the metallic hollow profile member 1 is shown separately to more clearly illustrate the configuration of the corner 12 formed between the outer flange 11 and the side wall of the metallic hollow profile member 1 proper, with the symmetrically projecting lugs 13 forming the undercut corner groove. In FIG.

3, the plastic sheath 2 is shown separately, which sheath 2 is extruded onto the metallic hollow profile 1 shown in FIG. 2, for example, by means of cross extrusion. This plastic sheath is formed with the cam strips 21 in the region of the corners.

Figure 4:
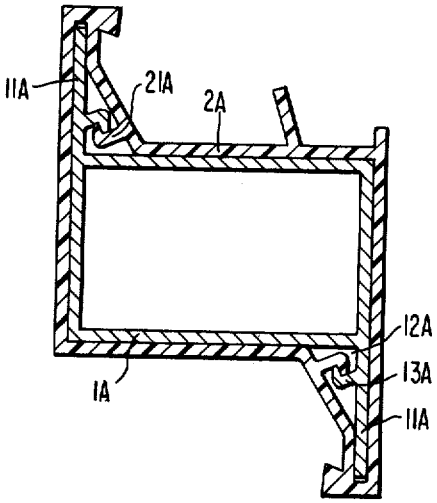
FIG. 4 is a cross-sectional view through a frame element constructed in accordance with another preferred embodiment of the present invention.
Figure 5:
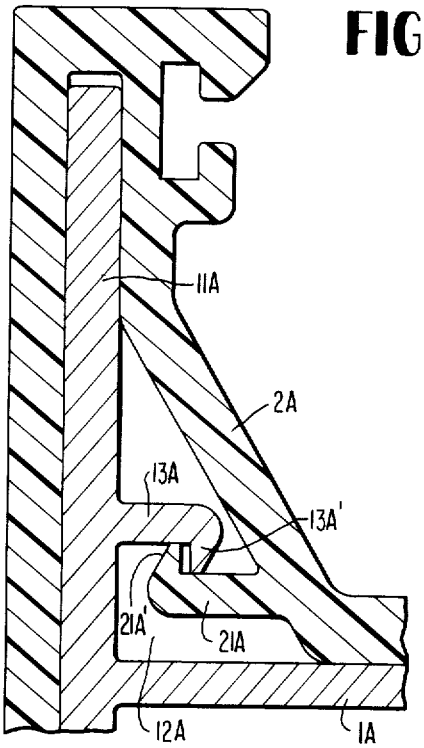
FIG. 5 is an enlarged partial view showing details of the corner construction of the frame element of FIG. 4.

FIG. 4 shows another embodiment of a frame element for a window frame or the like, wherein the mounting of the plastic sheath 2A in the zone of the corner 12A formed between the outer flange 11A and the metallic hollow profile member 1A is by means of interlocking hook elements 13A' and 21A'. As can be seen from the drawings, the FIG. 4 embodiment differs from the FIG. 1 embodiment in that the FIG. 4 interlocking hook elements 13A' and 21A' are not symmetrically shaped and in that a completely flush contacting of the plastic sheath 2A in the zone of the corner is not provided. FIG. 5 reveals details of this mounting of the plastic sheath 2A in the zone of the corner of the embodiment of FIG. 4. The plastic sheath 2A with a cam strip 21A is constructed with a projecting hook 21A' engaging behind the projecting lug hook 13A' of the projection or cam 13A to ensure the fixation of the sheath 2A in the zone of the corner groove 12A.

Figure 6:
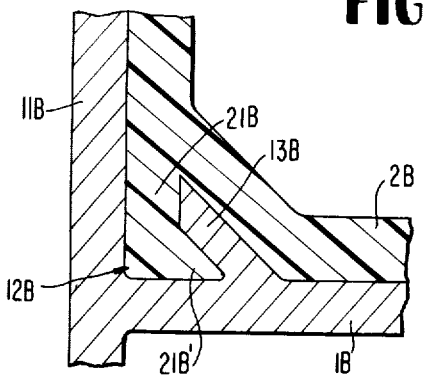
FIGS. 6–9 are views similar to FIG. 5 which show further preferred embodiments of frame elements formed of plastic-encased metallic hollow profile members and constructed in accordance with the present invention.

FIG. 6 illustrates another preferred embodiment of a corner connection between a metallic profile member 1B and plastic sheath 2B. In the FIG. 6 illustration, only the corner construction is shown, since the remainder of the cross-section of the sheath and the profile member can be similar to that described above with respect to FIGS. 1 and 4. In the corner area 12B between outer flange 11B and the adjacent horizontally extending side wall of profile member 1B, the sheath 2B is interlockingly engaged by way of cam strip 21B with corresponding cam 13B of member 1B. Cam strip 21B includes a hook portion 21B' which completely fills the groove formed between cam 13B and flange 11B and the side wall of the profile member 1B.

Figure 7:
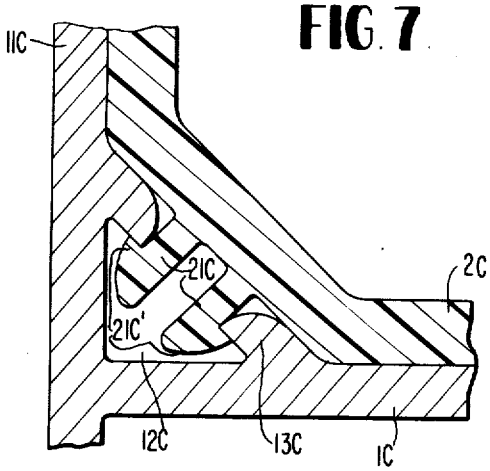

FIG. 7 illustrates another preferred embodiment of the present invention, with only the details of the connection at the corner 12C formed by the outer flange 11C and the adjacent horizontally extending side wall of profile member 1C being shown, it being understood that the remainder of the cross-section of the frame element is similar to that described above for FIGS. 1 and 4. In this embodiment, cams 13C are symmetrically arranged and extend along a common line toward one another. Sheath 2C includes a pair of cam strips 21C, each provided with a hook portion 21C' which engages over the cams 13C to hold the sheath firmly against the flange 11C and the outer side wall of the profile member 1C. In this embodiment, the sheath 2C is spaced from the outer surface of the profile member in the area of the corner 12C, however it is resiliently and firmly seated into position against both the outer flange 11C and the outer wall of profile member 1C in the area of the corner.

Figure 8:
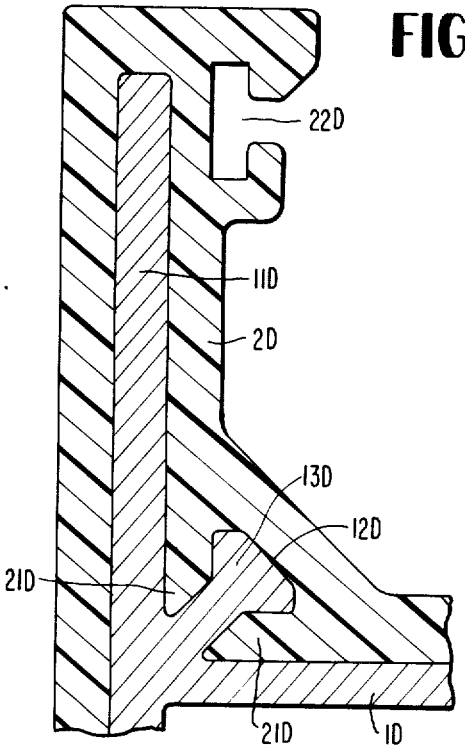

FIG. 8 shows another preferred embodiment of the interlocking elements at the corner of a frame element constructed in accordance with the present invention. Since the non-illustrated details of the overall configuration of the profile member 1D and sheath 2D are generally similar to that of the FIGS. 1 and 4 embodiments described above, details thereof have not been included in the drawing illustration. In the area of the corner 12D between the outer flange 11D and horizontally extending wall of profile member 1D, hammerhead shaped cam 12D is lockingly interengaged with cam strips 21D on the sheath 2D. 22D depicts a mounting groove similar to the one described for FIG. 1 and designated by reference numeral 22. In this FIG. 8 arrangement, the sheath 2D is engaged with the outer surface of profile member 1D at all points and the interlocking elements are symmetrically arranged at the corner 12D.

Figure 9:
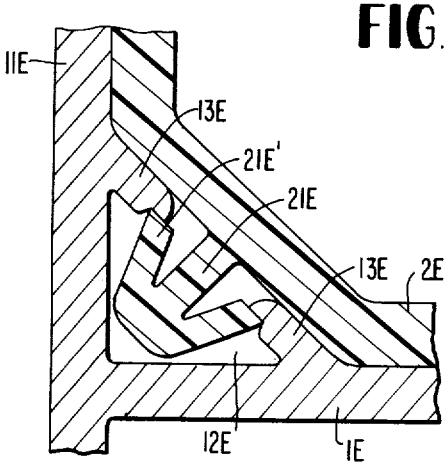

Yet another preferred embodiment of the interlocking corner construction is illustrated in FIG. 9, wherein outer flange 11E and the horizontally extending wall of profile member 1E form outer corner 12E. Sheath 2E is interlockingly connected with the profile member 1E by way of arrowhead shaped cam strip 21E having rearwardly extending hook-like projections 21E' engaging behind cams 13E of profile member 1E. In this embodiment, the cam and cam strips are symmetrically arranged and the sheath 2E is not in flush contact with the profile member 1E in the area immediately adjacent the corner 12E. However, as in the other preferred embodiments, the interlocking elements provide a firm connection of the sheath 2E in the area of the outer corner 12E.

It will be understood with respect to each of the embodiments of FIGS. 6–9 that a corresponding diagonally opposite corner construction will be provided as in the FIG. 1 and 4 embodiments.

By way of example, and not by way of limitation, it is further noted that preferred embodiments of the present invention utilize aluminum for the metallic hollow profile members. The thickness of the walls of the hollow profile members for use with window and door frames, is preferably in the range of 2 to 3 mm. In preferred embodiments of the hollow metallic profile members for use with window frames, the inside dimensions of the hollow space is 30 mm by 50 mm, while in preferred profile constructions for use with door frames, the dimensions of the hollow space are 50 mm by 70 mm. It is further noted that other materials, such as rolled sheetmetal could be used to form the hollow profile members.

The extruded synthetic resinous casing was preferably constructed of polyvinyl chloride PVC material, preferably soft PVC. The soft PVC is especially advantageous for coloring purposes, especially when the profile members are used in the construction industry under atmospheric influences. The thickness of the wall portions of the extruded synthetic resinous casings are preferably in the range of approximately 1.5 mm.

In the embodiments of FIGS. 1, 6 and 8, a solid mounting or complete filling of the corners is obtained. These solid corner constructions are particularly advantageous when use is made of the so-called cross extrusion process, wherein the synthetic resinous material layer is extruded while in the warm state directly onto the hollow metallic profile. The embodiments of FIGS. 4, 7 and 9, which provide air spaces in the mounting zone between the materials, are particularly advantageous in conjunction with manufacturing methods wherein the extruded synthetic resinous material shell is already solidified at the time of extrusion. The particular configuration of the connection between the metallic hollow profile member and the synthetic resinous material coating of the embodiments of FIGS. 4, 7 and 9 assure a firm solid clamping of the members to one another, with the just-mentioned type of extrusion with the synthetic resinous material in a solidified state.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A frame element, especially for door and window constructions, comprising:

a metallic profile member of hollow cross-sectional configuration formed by a plurality of interconnected side walls which surround and enclose a hollow space, said profile member including an outer flange formed as an extension of a first of said side walls such that a corner is formed on the outside of said profile member at the junction of said outer flange and a second of said side walls, a plastic sheath extrueded onto enclosing said profile member, and, attaching means for fixedly attaching said sheath to said profile member at said corner, said attaching means are constructed such that the sheath, as seen in cross section of the element, contacts the exterior surface of said profile member flush at all points thereof.

2. An element according to claim 1, wherein said attaching means includes respective abuttingly engaging interlocking means on each of said sheath and profile member.

3. An element according to claim 2, wherein the interlocking means on said profile member includes at least one outwardly projecting cam at said corner which forms an undercut corner groove, and wherein the interlocking means on said sheath includes a cam strip engaged in said corner groove.

4. An element according to claim 1, wherein said profile member includes a further outer flange formed as an extension of one of said side walls such that a further corner is formed on the outside of said profile member at the junction of said further outer flange and another of said side walls, and wherein attaching means are provided for fixedly attaching said sheath to said profile member at said further corner.

5. An element according to claim 4, wherein said attaching means includes respective abuttingly engaging interlocking means on each of said sheath and profile member.

6. An element according to claim 5, wherein the interlocking means on said profile member includes at least one outwardly projecting cam at each of said corners which forms an undercut corner groove, and wherein the interlocking means on said sheath includes cam strips engaged in said corner grooves.

7. An element according to claim 6, wherein the corner grooves on said profile member are constructed symmetrically with respect to a plane extending parallel to said side walls and through a centerline of said hollow space.

8. An element according to claim 4, wherein said profile member is of rectangular configuration with four side walls, and wherein said corners are arranged at respective diagonally opposite corners of said rectangular configuration.

9. An element according to claim 1, wherein said sheath includes mounting lugs and grooves formed therein.

10. An element according to claim 1, wherein said attaching means includes one cam at said corner, said cam extending from one of said outer flange and said second side wall toward the other of said outer flange and said second side wall, and wherein said sheath includes a single cam strip which completely fills the corner groove formed between said cam and said outer flange and said second side wall.

11. A frame element, especially for door and window constructions, comprising:

a metallic profile member of hollow cross-sectional configuration formed by a plurality of interconnected side walls which surround and enclose a hollow space, said profile member including an outer flange formed as an extension of a first of said side walls such that a corner if formed on the outside of said profile member at the junction of said outer flange and a second of said side walls, a plastic sheath extruded onto and enclosing said profile member, and attaching means for fixedly attaching said sheath to said profile member at said corner, said profile member includes a further outer flange formed as an extension of one of said side walls such that a further corner is formed on the outside of said profile member at the junction of said further outer flange and another of said side walls, attaching means for fixedly attaching said sheath to said profile member at said further corner, said attaching means includes respective abuttingly engaging interlocking means on each of said sheath and said profile member, the interlocking means on said profile member includes at least one outwardly projecting cam at each of said corners which forms an undercut corner groove, the interlocking means on said sheath includes cam strips engaged in said corner grooves, the corner grooves on said profile member are constructed symmetrically with respect to a plane extending parallel to said side walls and through a center line of said hollow space, said interlocking means are constructed such that the sheath, as seen in cross section of the element, contacts the exterior surface of said profile member flush at all points thereof.

12. A frame element, especially for door and window constructions, comprising:

a metallic profile member of hollow cross-sectional configuration formed by a plurality of interconnected side walls which surround and enclose a hollow space, said profile member including an outer flange formed as an extension of a first of said side walls such that a corner is formed on the outside of said profile member at the junction of said outer flange and a second of said side walls, a plastic sheath extruded onto and enclosing said profile member, and attaching means for fixedly attaching said sheath to said profile member at said corner, said attaching means includes respective abuttingly engaging interlocking means on each of said sheath and profile member, the interlocking means on said profile member includes at least one outwardly projecting cam at said corner which forms an undercut corner groove, the interlocking means on said sheath includes a cam strip engaged in said corner groove, said interlocking means are constructed such that the sheath, as seen in cross-section of the element, contacts the exterior surface of said profile member flush at all points thereof.

13. A frame element, especially for door and window constructions, comprising:

a metallic profile member of hollow cross-sectional configuration formed by a plurality of interconnected side walls which surround and enclose a hollow space, said profile member including an outer flange formed as an extension of a first of said side walls such that a corner is formed on the outside of said profile member at the junction of said outer flange and a second of said side walls, a plastic sheath extruded onto and enclosing said profile member, and attaching means for fixedly attaching said sheath to said profile member at said corner, said attaching means includes respective abuttingly engaging interlocking means on each of said sheath and said profile member, the interlocking means on said profile member includes two similar cams projecting respectively, one each, from said outer flange and from said second side wall to form a groove at said corner, the interlocking means on said sheath includes a cam strip engaged in said corner groove.

14. An element according to claim 13, wherein said corner groove and said cam strip are constructed symmetrically with respect to a plane bisecting the angle formed by said corner.

15. An element according to claim 13, wherein the interlocking means are constructed such that the sheath, as seen in cross-section of the element, only partially contacts the profile member in the zone of said corner.

16. An element according to claim 13, wherein said cams extend from the respective outer flange and second side wall along a common plane which is perpendicular to a plane bisecting the angle formed at said corner by said outer flange and second side wall.

17. An element according to claim 16, wherein said sheath includes a single cam strip which completely fills the corner groove formed between said cam and said outer flange and second side wall.

18. An element according to claim 16, wherein said sheath includes two cam strips spaced from one another and engageable one each with respective ones of said cams.

19. An element according to claim 18, wherein said cam strips include respective oppositely facing hook portions at the ends thereof for engaging said cams.

20. An element according to claim 13, wherein said cam strip on said sheath is a single cam strip extending toward said corner along a plane bisecting said corner, said single cam strip being of arrowhead shape with the point of the arrow facing the corner and with respective lateral sides having the rear ends thereof engaged over said two similar cams of said profile member.

21. A frame element, especially for door and window constructions, comprising:

a metallic profile member of hollow cross-sectional configuration formed by a plurality of interconnected side walls which surround and enclose a hollow space, said profile member including an outer flange formed as an extension of a first of said side walls such that a corner is formed on the outside of said profile member at the junction of said outer flange and a second of said side walls, a plastic sheath extruded onto and enclosing said profile member, and attaching means for fixedly attaching said sheath to said profile member at said corner, said attaching means includes respective abuttingly engaging interlocking means on each of said sheath and said profile member, the interlocking means on said profile member includes at least one outwardly projecting cam at said corner which forms an undercut corner groove, the interlocking means on said sheath includes a cam strip engaged in said corner groove, said groove is formed entirely inside the outer envelope of the intersection of said outer flange and said second side wall.

22. A frame element, especially for door and window constructions, comprising:

a profile member of hollow cross-sectional configuration formed by a plurality of interconnected side walls which surround and enclose a hollow space, said profile member including an outer flange formed as an integral extension of a first of said side walls such that a corner is formed on the outside of said profile member at the junction of said outer flange and a second of said side walls, a sheath completely enclosing said profile member including said outer flange, and attaching means for fixedly attaching said sheath to said profile member at said corner, said attaching means includes respective abuttingly engaging interlocking means on each of said sheath and said profile member, the interlocking means on said profile member includes two similar cams projecting respectively, one each from said outer flange and from said second side wall to form a groove at said corner, said cams extend from the respective outer flange and second side wall along a common plane which is perpendicular to a plane bisecting the angle formed at said corner by said outer flange and second side wall, the interlocking means on said sheath includes a cam strip engaged in said corner groove.

23. An element according to claim 22, wherein said profile member includes a further outer flange formed as an extension of one of said side walls such that a further corner is formed on the outside of said profile member at the junction of said further outer flange and another of said side walls, and wherein attaching means are provided for fixedly attaching said sheath to said profile member at said further corner.

24. An element according to claim 23, wherein said further attaching means includes respective abuttingly engaging further interlocking means on each of said sheath and said profile member, and wherein the further interlocking means on said profile member includes at least one outwardly projecting cam at said further corner which forms an undercut corner groove, and wherein the further interlocking means on said sheath includes a further cam strip engaged in said undercut corner groove.

25. An element according to claim 22, wherein the interlocking means are constructed such that the sheath, as seen in cross-section of the element, only partially contacts the profile member in the zone of said corner.

26. An element according to claim 22, wherein said sheath includes a single cam strip extending toward said corner along a plane bisecting said corner, said single cam strip being of arrowhead shape with the point of the arrow facing the corner and with respective lateral sides having the rear ends thereof engaged over said cams.

* * * * *